United States Patent [19]

Cuman et al.

[11] 4,403,931

[45] Sep. 13, 1983

[54] SEMI-AUTOMATIC PLANT FOR MANUFACTURING SHAPED CONCAVE VITREOUS CHINA OBJECTS

[75] Inventors: Giorgio Cuman, Milan; Mario Biadigo, Pordenone, both of Italy

[73] Assignee: Ideal Standard S.p.A., Milan, Italy

[21] Appl. No.: 343,237

[22] Filed: Jan. 27, 1982

[30] Foreign Application Priority Data

Feb. 6, 1981 [IT] Italy ..... 46813 A/81

[51] Int. Cl.[3] ..... B28B 1/26; B28B 15/00; B28B 17/00

[52] U.S. Cl. ..... 425/84; 425/225; 425/261; 425/350; 425/404

[58] Field of Search ..... 425/88, 350, 404, 405, 425/DIG. 200, DIG. 201, DIG. 202, 84, 256, 259, 261, 346, 347, 348, 225

[56] References Cited

U.S. PATENT DOCUMENTS

| | | | |
|---|---|---|---|
| 1,809,861 | 6/1931 | Miller | 425/404 |
| 1,863,628 | 6/1932 | Hanley et al. | 425/88 |
| 2,294,476 | 9/1942 | Mooney | 425/84 |
| 3,178,493 | 4/1965 | Blackburn et al. | 425/84 |
| 3,199,164 | 8/1965 | Emmel et al. | 425/84 |
| 3,416,203 | 12/1968 | Ozenne et al. | 425/261 |
| 3,462,810 | 8/1969 | Matsushima | 425/404 |
| 3,813,202 | 5/1974 | Rossler | 425/404 |

FOREIGN PATENT DOCUMENTS

| | | | |
|---|---|---|---|
| 644627 | 1/1979 | U.S.S.R. | 425/88 |

*Primary Examiner*—Willard E. Hoag
*Attorney, Agent, or Firm*—Brisebois & Kruger

[57] ABSTRACT

A plant including at least two parallel casting benches (1), each comprising a plurality of double-face moulds (3) which can be clamped together into a pack so as to define a succession of vertical cavities for casting shaped concave vitreous china objects (6); means (13) for rapidly drying the moulds of each casting bench; at least one vertical parking unit (4) in the form of superposed shelves lying between said two casting benches and arranged to accumulate the articles during their hardening stage; means (5) for transferring the articles, after being withdrawn from the moulds, from the two casting benches to a motorized holding table (11) provided at the base of said vertical parking unit; end lifting-lowering means (8), (88) for loading and unloading this latter; means (18), disposed at the discharge end of said vertical parking unit, for automatically loading the articles on to fork trucks (20); at least one rotatable platform (19) for these latter; a drier (23) through which the full fork trucks pass; transfer means (21), (221), (50) for handling the fork trucks both at the drier inlet and outlet.

14 Claims, 14 Drawing Figures

SEMI-AUTOMATIC PLANT FOR MANUFACTURING SHAPED CONCAVE VITREOUS CHINA OBJECTS

This invention relates to a plant for casting shaped concave vitreous china articles, in which the multiple passages of the pieces from one operating station to another, starting from the casting stage and terminating in the stage in which the finished glazed product is accumulated ready for firing, are carried out automatically.

Said articles are known to be individually constituted by a shaped concave ceramic support, the exposed surfaces of which are glazed.

Briefly, a normal production cycle for such articles usually comprises the following successive operating stages:

casting the pieces;

withdrawing the pieces from the moulds and hardening the withdrawn pieces;

finishing the hardened pieces;

depositing and drying the finished pieces on trucks comprising two opposing combs or columns of superposed forks;

loading the pieces on to an overhead conveyor, and drying them in the vicinity of a firing furnace;

unloading said overhead conveyor and checking the product by brushing with oil;

glazing;

unloading and depositing the glazed product;

loading the furnace trucks and finally firing the glazed product;

unloading the finished product from said furnace trucks.

In such a production cycle, the multiple passage of the articles between the various operating stations of the production cycle, and particularly with reference to said loading and unloading operations, are carried out manually.

Moreover, in known plants, much time is lost in drying the moulds between one casting operation and the next, with all the operational and economical drawbacks which derive from this.

The same applies to washing the support bases of the moulded objects.

The main object of the present invention is to provide a plant for the vertical casting, automatic accumulation and forced drying of concave vitreous china articles which operates substantially automatically and enables high hourly production rates to be attained with modest use of labour.

According to the invention, the proposed plant comprises at least two parallel vertical casting benches, on each of which there is slidably disposed a plurality of moulds designed to be clamped together to form a pack during a casting operation, and lying between two blowing ports which are disposed below and above the corresponding casting bench and parallel thereto.

The purpose of said blowing ports is to convey hot air to the moulds in order to dry them. Each individual mould is constituted essentially by a plaster body disposed transversely to its casting bench, and of which those faces which look towards the opposing ends of the casting bench comprise respectively a "male" part and a "female" part such that each mould is arranged to define, in cooperation with that which follows or precedes it, a vertical casting cavity for moulding an article.

Between said at least two casting benches there is provided a parking unit for accumulating the articles during the hardening stage, and comprising a set of superposed roller tables which are served at one end by a lifting-lowering loading device.

This latter receives the pieces which have just been withdrawn from the moulds and are each resting on a convenient support base, from a further motorised roller table which lies substantially at the level of said at least two casting benches, along which, and more precisely on those sides thereof which face the vertical parking unit, there are slidably disposed two transfer tables comprising rollers which lie transversely to their casting benches.

At the other end of the vertical parking unit there is provided a lifting-lowering unloading device arranged to serve a finishing station which terminates in a fork loading member, this latter being mobile horizontally.

When in its emerged position, said fork member lies above part of a rotatable platform, which is also mobile vertically, and on to and from which trucks comprising two opposing columns of superposed forks are respectively loaded and unloaded. These trucks are handled by a first transfer carriage provided with a double loading platform, which is disposed transversely to said at least two casting benches.

Said transfer carriage runs in front of the inlet ports of a drying oven in order to insert the full fork trucks therein, and a second transfer carriage entirely similar to the preceding runs in front of the outlet ports of the said drying oven.

The purpose of this latter transfer carriage is to extract the full fork trucks from the drier and feed them to at least one rotatable and vertically mobile platform, from which, when unloaded, said fork trucks are fed by the said second transfer carriage to a service rail for serving the first transfer carriage.

Downstream of said at last one platform, there are provided a device for unloading the shower trays from the fork trucks, a table for testing the articles and a conveyor for these latter, along which there is disposed a suitable glazing station, and from the downstream end of which, after the glazed product has been unloaded, the support bases for the shower trays are fed, after being washed, to the aforesaid at least two casting benches ready for further use.

The merits and constructional characteristics of the invention will be more apparent from the detailed description given hereinafter which relates by way of example to the manufacture of shower trays, and is made with reference to the accompanying drawings, it being apparent that it can refer to the manufacture of any similar article.

Figure 8:
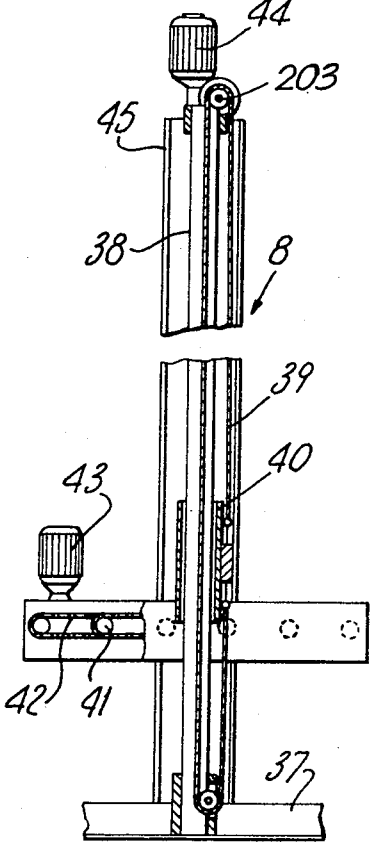

FIGS. 8 (sheet I), 9 (sheet VII) and 10 (sheet VIII) show a side view, plan view and front view respectively, of one of the lifting-lowering devices provided for serving each vertical parking unit of the invention.

Figures 9, 11:
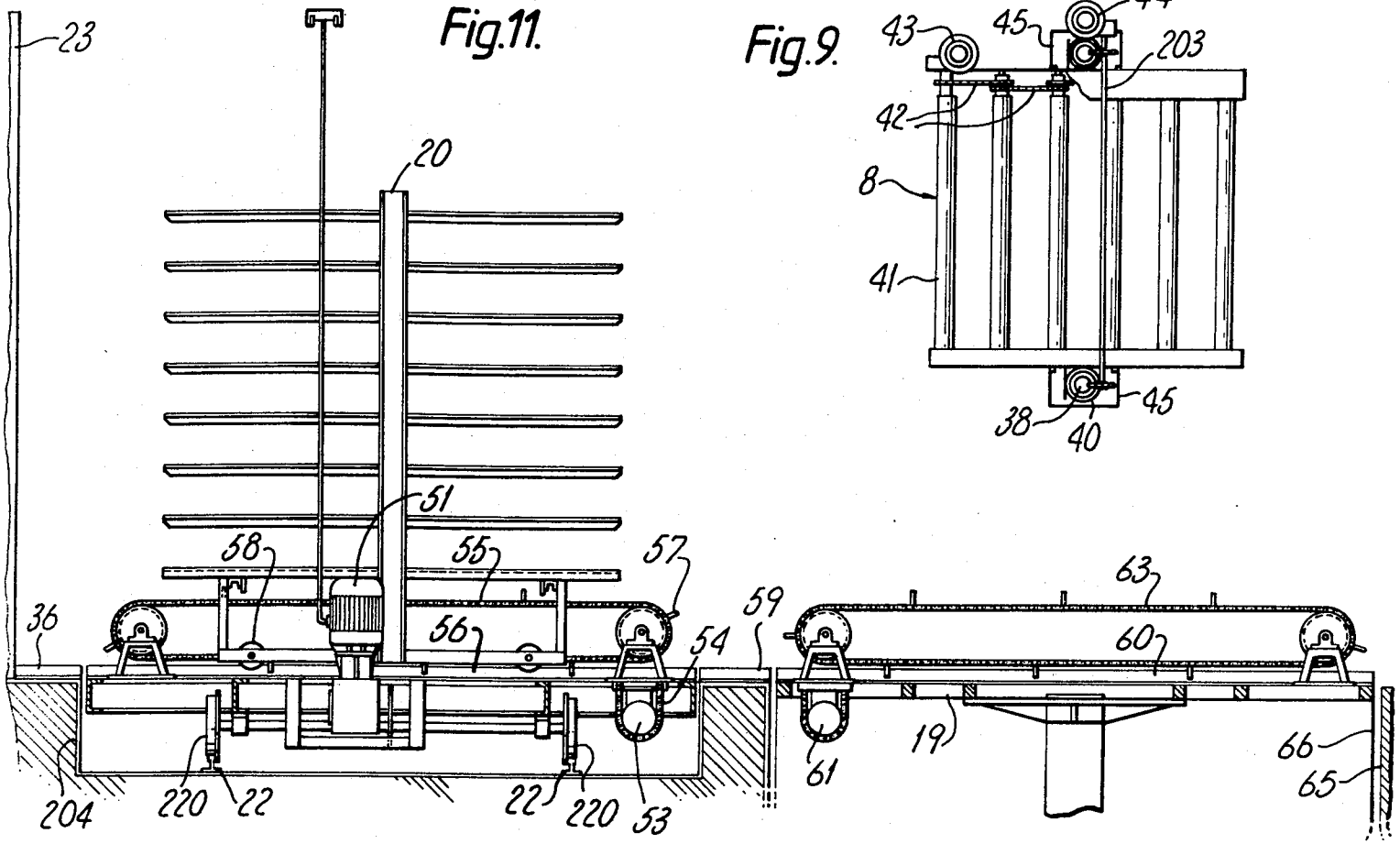

FIG. 11 shows the top of a rotatable platform of the invention, together with the corresponding transfer carriage.

Figure 12:
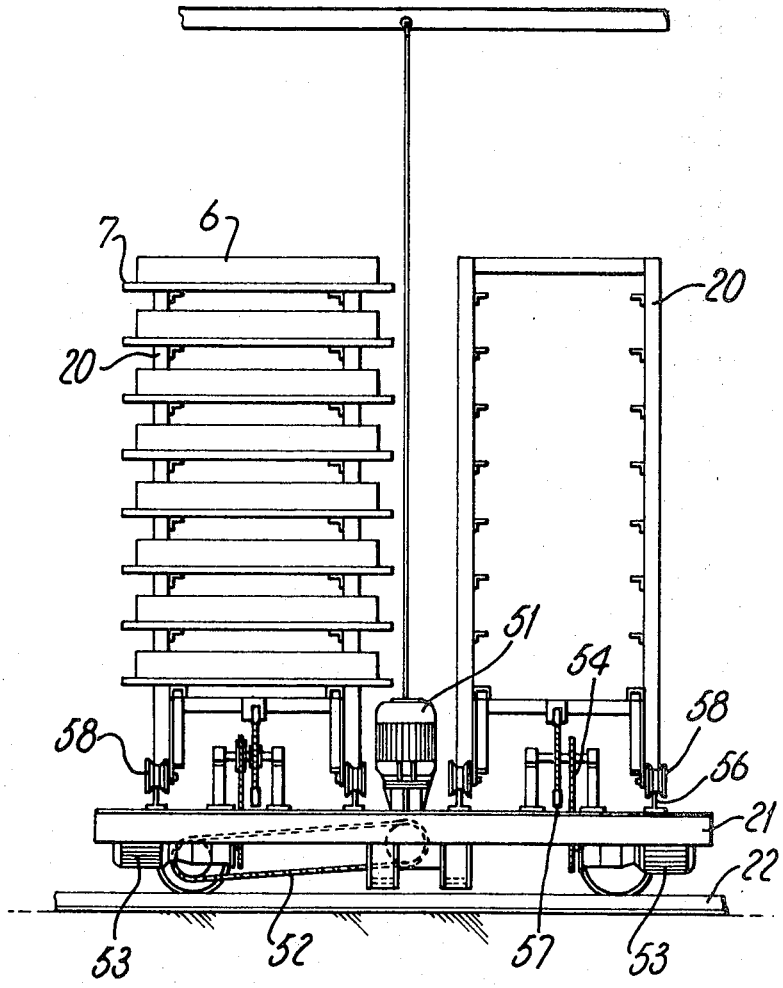

FIG. 12 is an external longitudinal view of the transfer carriage of the preceding figure.

Figure 13:
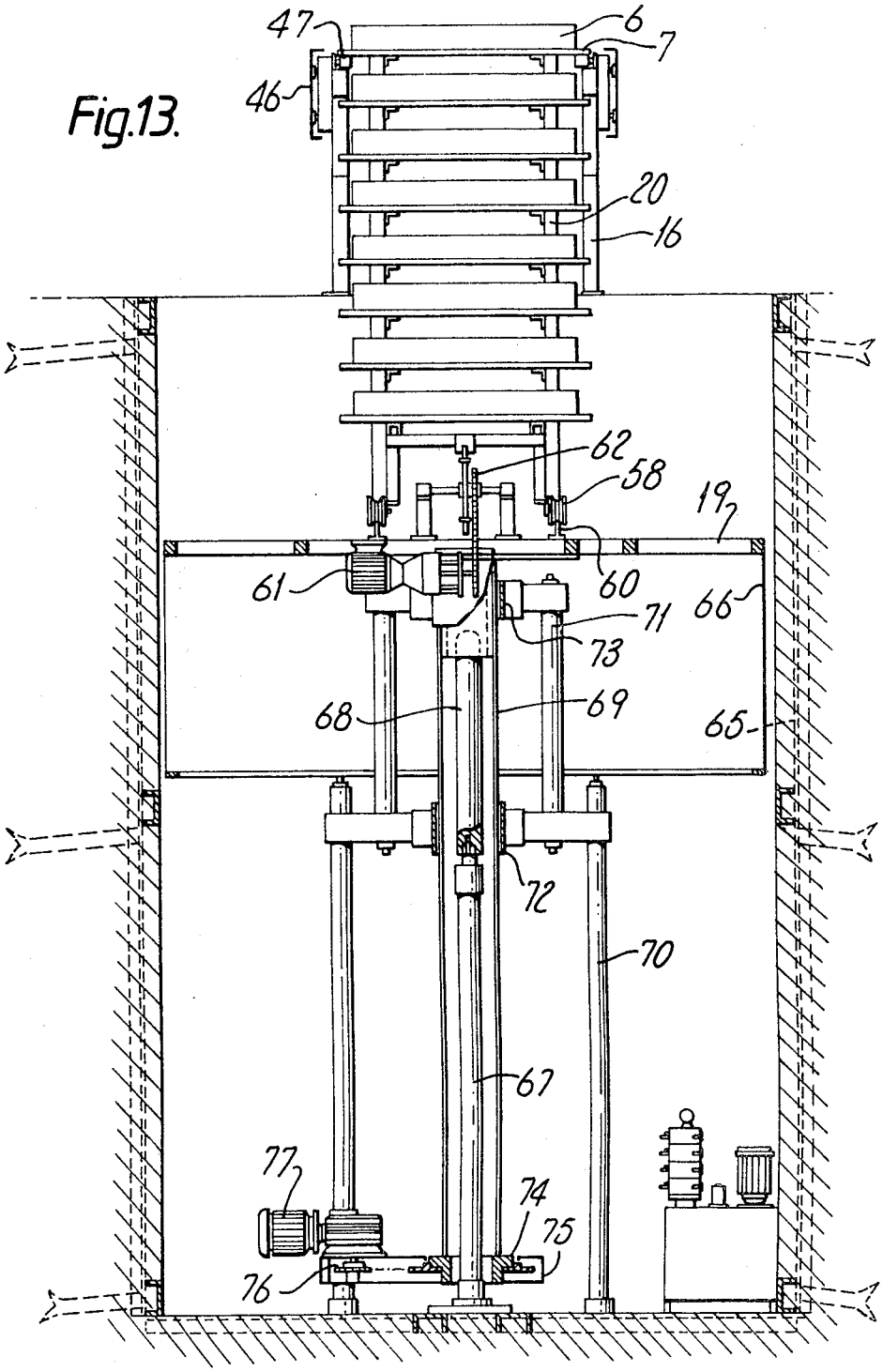
Figure 14:
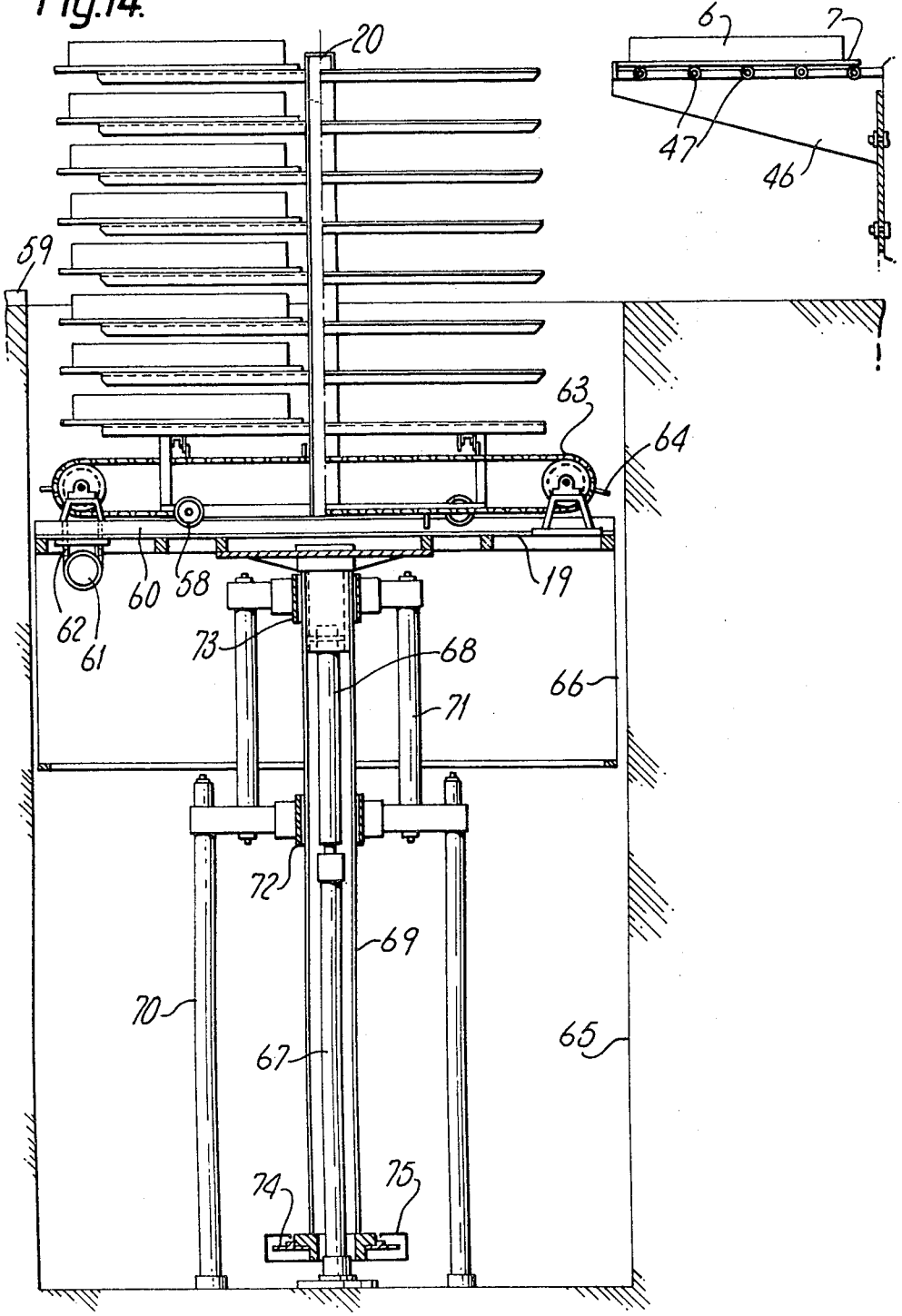

FIGS. 13 and 14 are two orthogonal longitudinal sections through one of the rotatable platforms of the invention.

Figure 1:
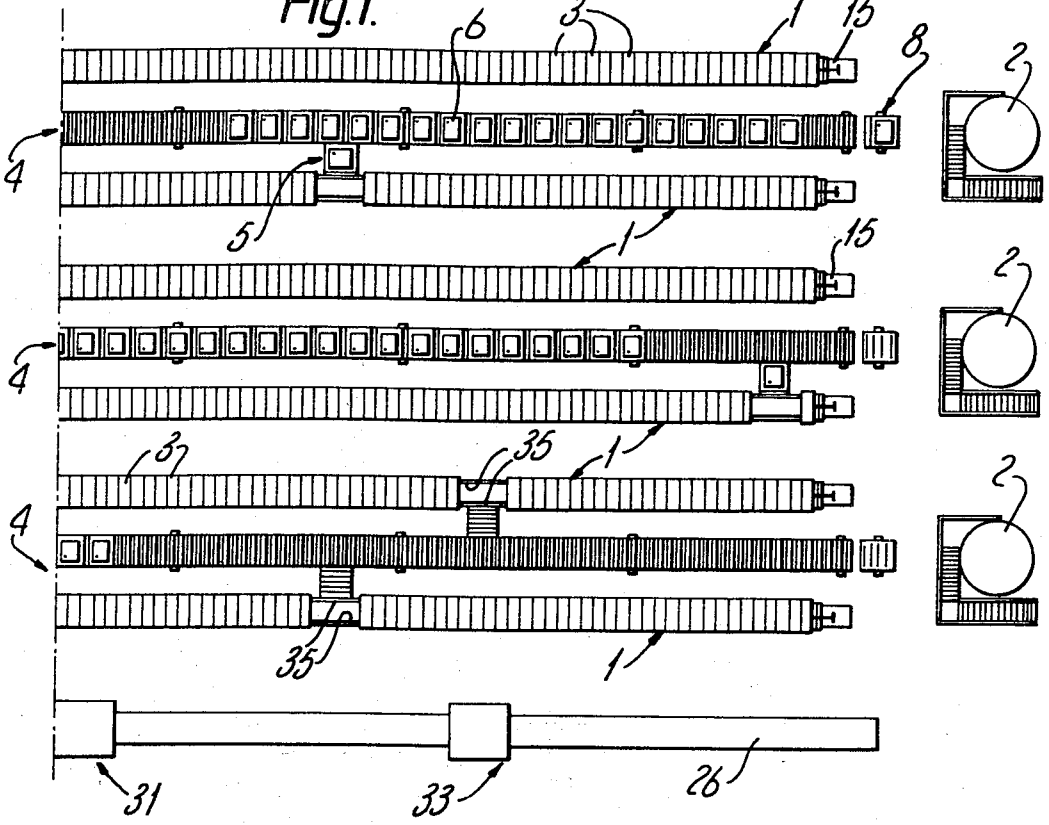
FIGS. 1 and 2 are an overall diagrammatic plan view of a plant according to the invention.
Figure 2:
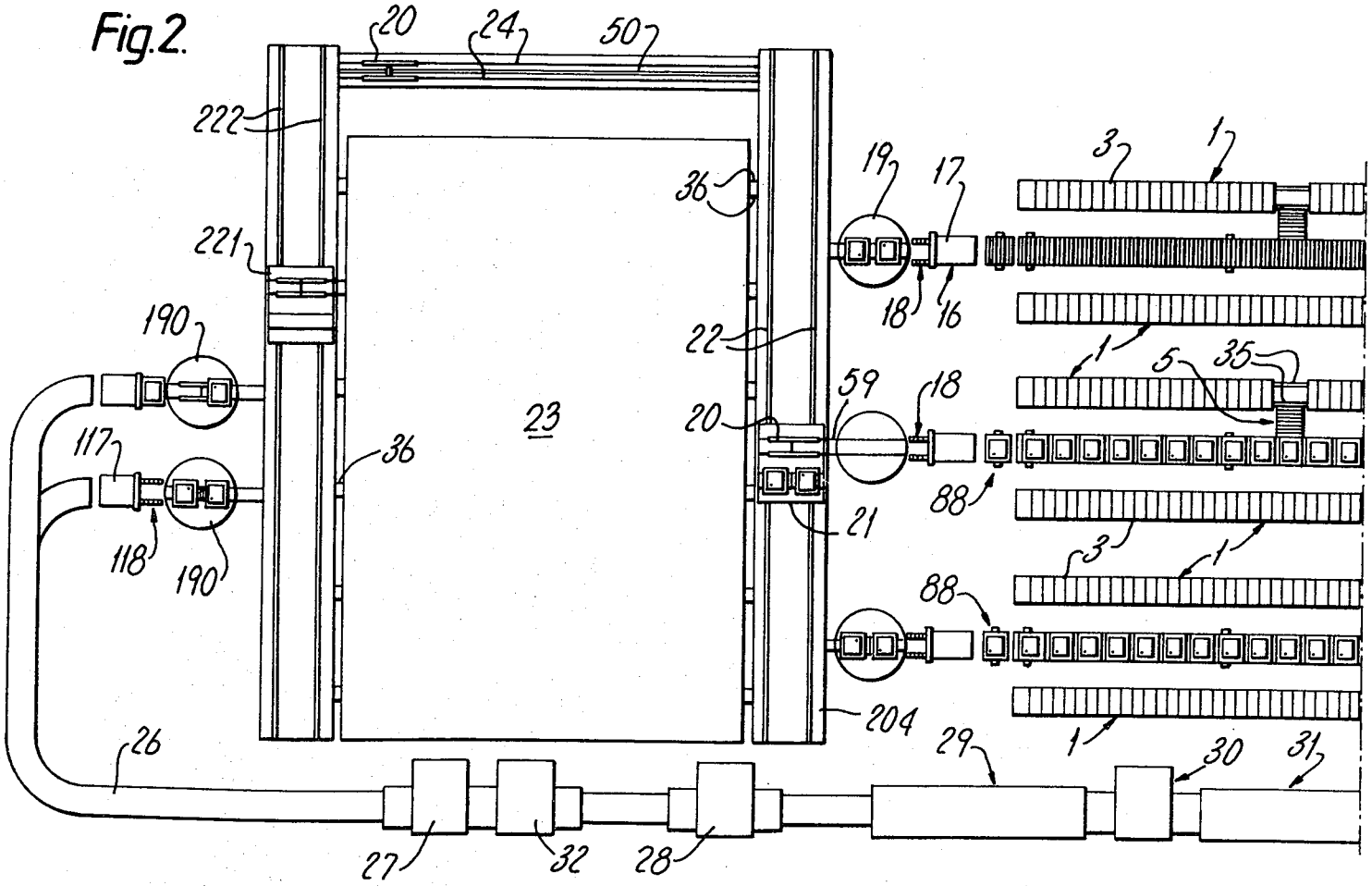

The said figures, and in particular FIGS. 1 and 2, show three pairs of casting benches 1, each pair being served by a tank 2 disposed at a higher level at one end of each pair of benches, for feeding the slip to the plaster moulds disposed on each casting bench, in known manner.

Figure 7:
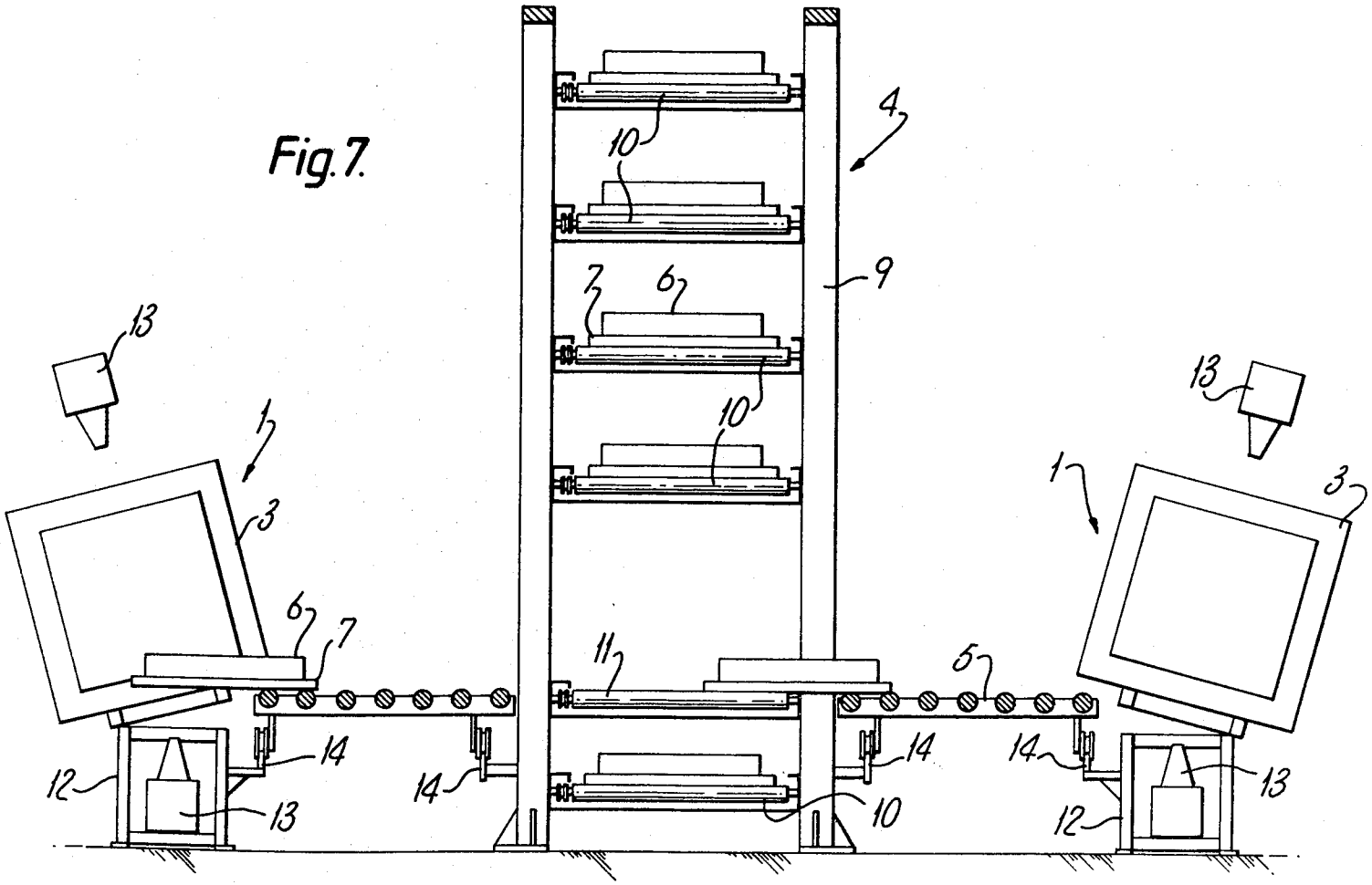
FIG. 7 is a section on the line VII—VII of FIG. 6.

Each casting bench 1, as also shown in FIG. 7, comprises a horizontally extending base structure 12, on which are disposed two rails 35, visible in FIG. 1, which are placed at slightly different levels as is usual in the ceramic field for the production of sanitary appliances.

A plurality of moulds 3, which in this specific case are one hundred and twenty in number, is slidably disposed on each base structure 12 which defines one casting bench 1.

Two devices 15 are disposed at the opposing ends of each base structure 12 for blocking the corresponding plurality of moulds 3. Each of these latter is formed from plaster of Paris, and is of the double-face type.

More specifically, each individual mould 3 is composed of a central body connected to an underlying trolley slidably disposed on the rails 35 of the relative base structure 12, and those faces which look towards the opposing ends of the corresponding casting bench are provided respectively with a male part and a female part.

In this manner, each pair of moulds 3, when brought together, is designed to constitute a vertical casting cavity for moulding a shower tray.

At the centre of the base structure 12 of each casting bench 1, there is disposed a lower blowing chamber 13, of which the upper longitudinal face is provided with a blowing port facing the base of the corresponding line of moulds 3 (FIG. 7).

In addition, above the said line of moulds 3 there is provided a second blowing chamber 13, or upper chamber, of which the lower face is provided with a longitudinal blowing port facing the top of the corresponding line of moulds 3 (FIG. 7).

Each pair of blowing chambers 13 is fed by hot air, and extends over the entire length of the bench 1. As shown in FIGS. 1 and 2, a vertical parking unit 4 is disposed parallel to, and between, each pair of casting benches 1 for the hardening of the articles which have just been withdrawn from the moulds.

Figure 3:
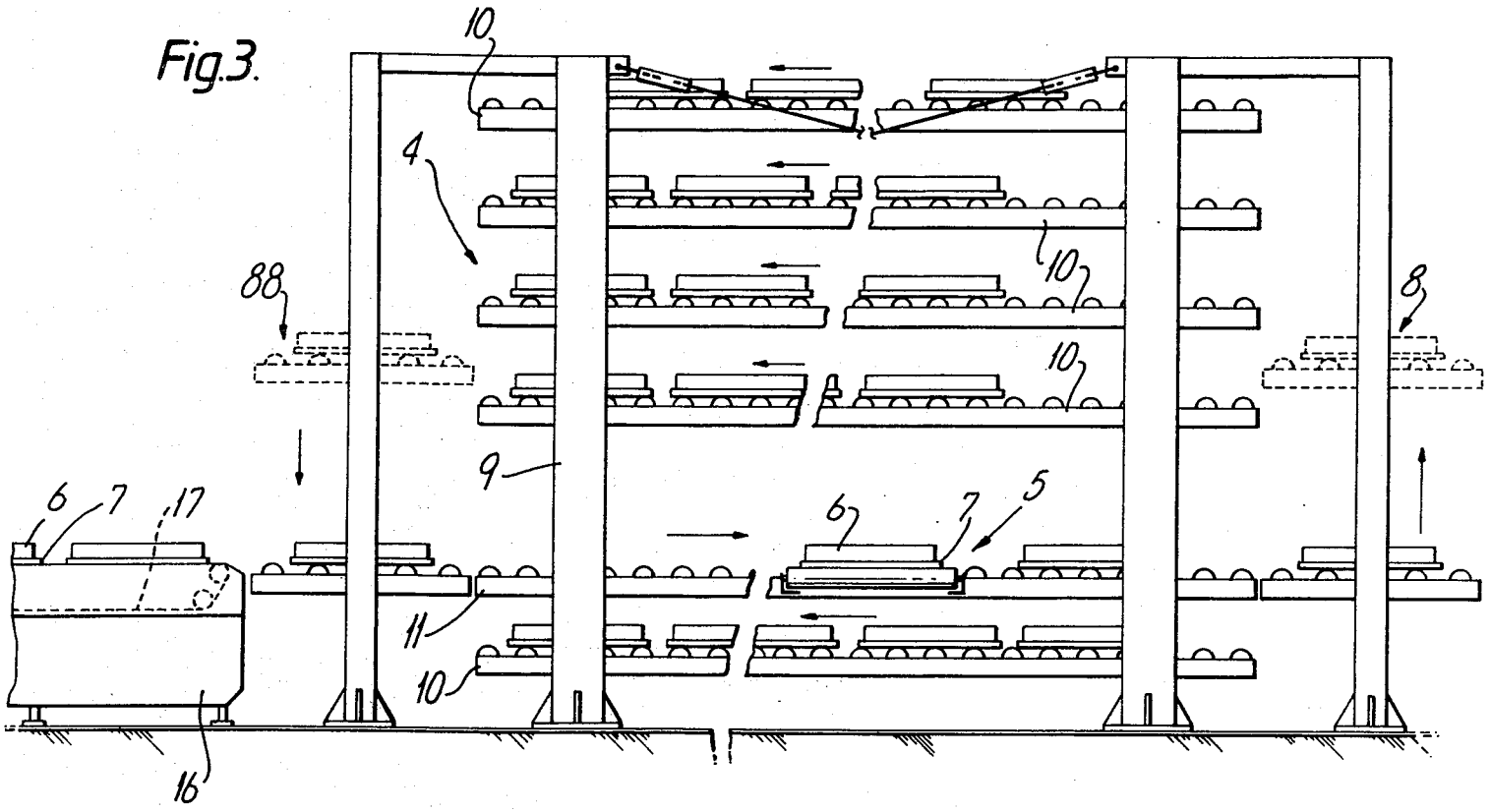
FIG. 3 is a side view of one of the vertical parking units with which the invention is provided.

With reference to FIGS. 3 and 7, each vertical parking unit 4 is composed of a framework 9, the upper part of which is provided with four accumulation tables 10 with motorised rollers, designed to receive a plurality of shower trays 6 each disposed on a suitable support base 7.

The rollers of each accumulation table 10 are linked together, and are driven by a geared motor, not shown, which is disposed at one end of the corresponding accumulation table 10.

Below said four accumulation tables 10 there is disposed a service table 11, which is also of the roller type and motorised as in the case of the aforesaid accumulation tables, and occupies a level practically equal to that occupied by the rails 35 of the corresponding casting benches 1.

Below the service table 11, which is also disposed above the framework 9 of the said vertical parking unit 4, there is provided a further accumulation table 10 completely identical to those described heretofore.

Thus, for each vertical parking unit 4 there are provided five accumulation tables 10, but their number must in no way be taken as limiting, because it depends on the number of moulds of the corresponding casting benches 1, and thus on the daily production of shower trays which it is required to reach.

As shown in FIGS. 1 and 7, between each casting bench 1 and the respective vertical parking unit 4, a horizontal roller transfer table is slidably disposed longitudinally, with its component rollers parallel to the rails 35 of the respective casting bench 1.

In addition, the upper generating lines of the rollers of each transfer table 5 lie substantially at the level occupied by the upper generating lines of the motorised rollers which comprise the respective service table 11.

As shown in FIG. 7, each transfer table 5 is provided lowerly with four grooved wheels slidably disposed on two rolling tracks 14 which are supported by the corresponding side of the framework 9 and by the base structure 12 of the respective casting bench 1.

Figure 10:
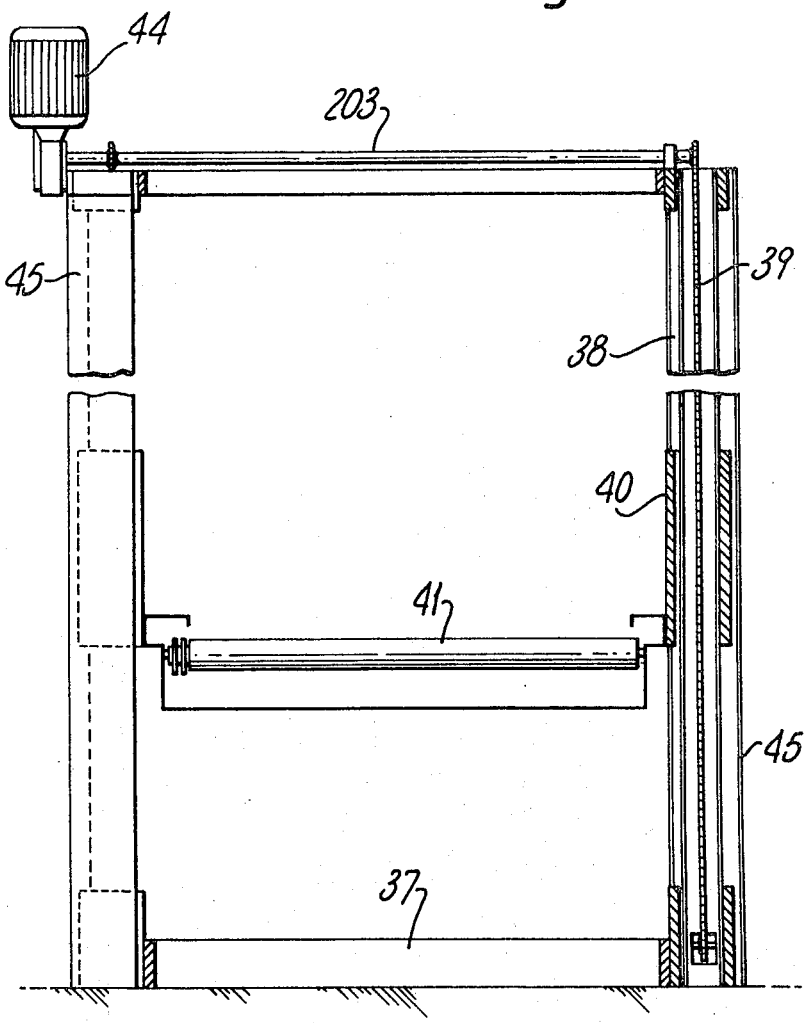

A lifting-lowering device 8, described hereinafter with reference to FIGS. 8, 9 and 10, is provided at that end of each vertical parking unit 4 which lies in proximity to the corresponding tank 2 for the slip.

Each of said lifting-lowering devices 8, the function of which is to load the accumulation tables 10 of the corresponding vertical parking unit from the service table 11, comprises a base 37 from which two hollow cylindrical columns 38 rise, their vertical extension corresponding to that of the respective framework 9.

Two sleeves 40 are mounted slidably on the columns 38, and support a table 41 with motorised rollers linked together by chains 42 connected to an end geared motor unit 43.

A horizontal shaft 203, driven by a geared motor unit 44, is rotatably mounted on the tops of the pair of columns 38.

On the horizontal shaft 203 there are keyed two sprocket wheels, about which there pass two chains 39, which also pass about two further sprocket wheels rotatably mounted at the base of the columns 38 (FIG. 8).

One of the straight portions of each individual chain 39 is housed inside the corresponding column 38, whereas the other straight portion of the said chain 39 is disposed externally to the relative column 38 to enable it to be connected to its sleeve 40.

Finally, each column 38 and the respective chain 39 are enclosed by a suitable casing 45.

At the other end of each vertical parking unit 4, which corresponds to its discharge end, there is disposed a second lifting-lowering device 88, which will not be described as it is entirely similar to the lifting-lowering device 8 just described.

Figure 6:
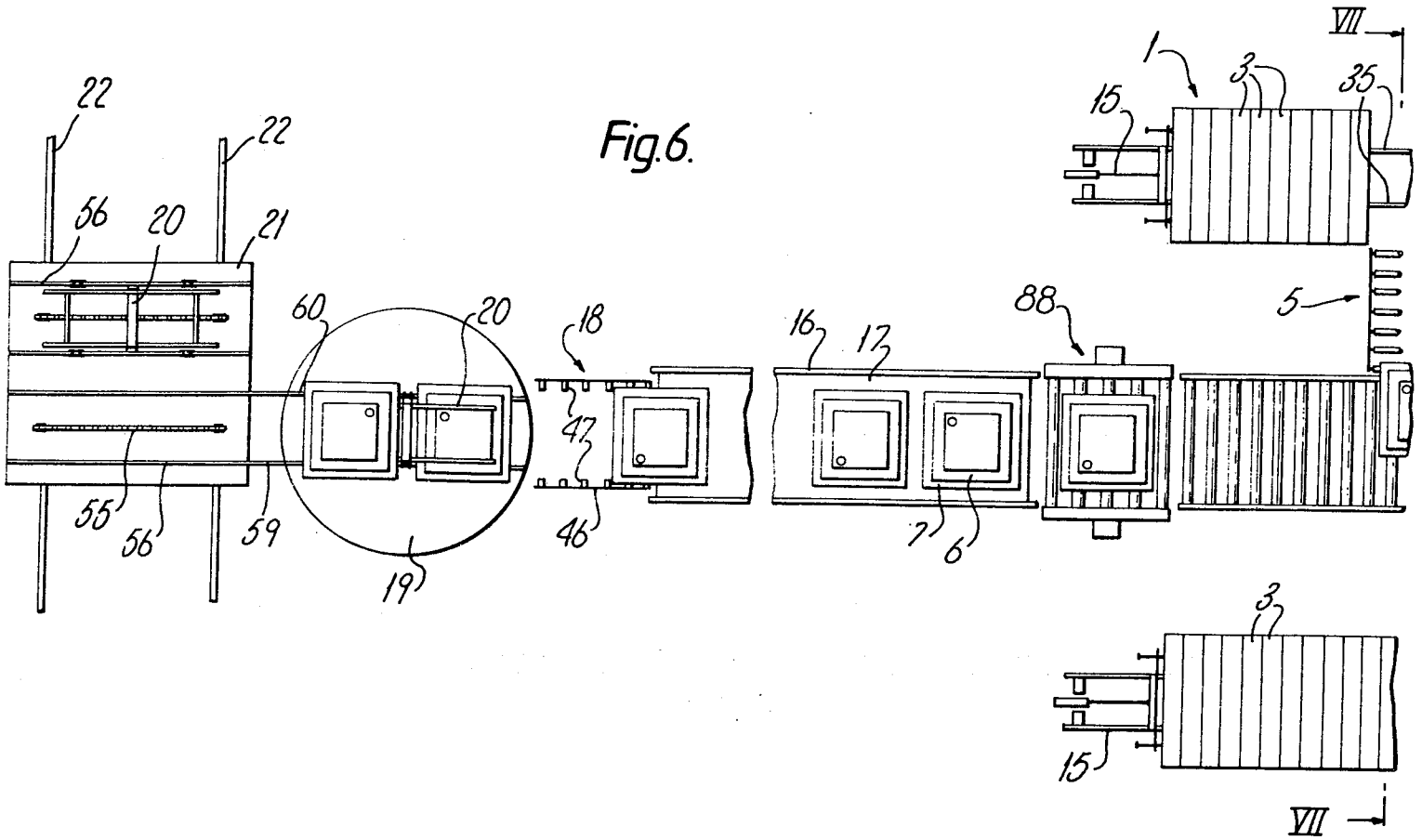
FIG. 6 is a plan view of the downstream end of one of the vertical parking units of the invention.

As shown in FIGS. 1 and 6, immediately downstream of each lifting-lowering device 88, there is provided a finishing station 16.

This latter is composed of a frame of suitable length, aligned with the corresponding vertical parking unit 4, and on the top of which a conveyor belt 17 is disposed.

The upper straight portion of this latter, conveniently supported from below, lies substantially at the level of the upper generating lines of the rollers which comprise the corresponding service table 11.

The said belt 17 is driven by a suitable drive, not shown, which is controlled intermittently by the personnel responsible for finishing the articles.

On the downstream end of each finishing station 16, a loading member 18 is provided (FIG. 5), driven with horizontal reciprocating rectilinear motion parallel to the longitudinal extension of the finishing station 16.

This loading member 18 comprises a fork 46 of which the arms, essentially constituted by a vertical trapezoidal plate, are disposed parallel to the sides of the finishing station 16.

Below the conveyor belt 17 of this latter, there is connected the body of a horizontally lying cylinder-piston unit 48, of which the rod is connected to the central zone of the cross-member of the fork 46.

From the rear face of the said cross-member of said fork 46 there branch horizontal cylindrical guide bars 49 which are mounted so that they slide relative to the downstream end of the finishing station 16.

On the upper longitudinal edges of the arms of the fork 46 are rotatably mounted two inwardly projecting rows of opposing rollers 47, of which the upper generating lines lie substantially at the level of the upper straight portion of the conveyor 17.

As shown in FIG. 6, the distance between the arms of the fork 46 is slightly greater than the corresponding dimension of the support bases 7 of the shower trays 6.

Figures 4, 5:
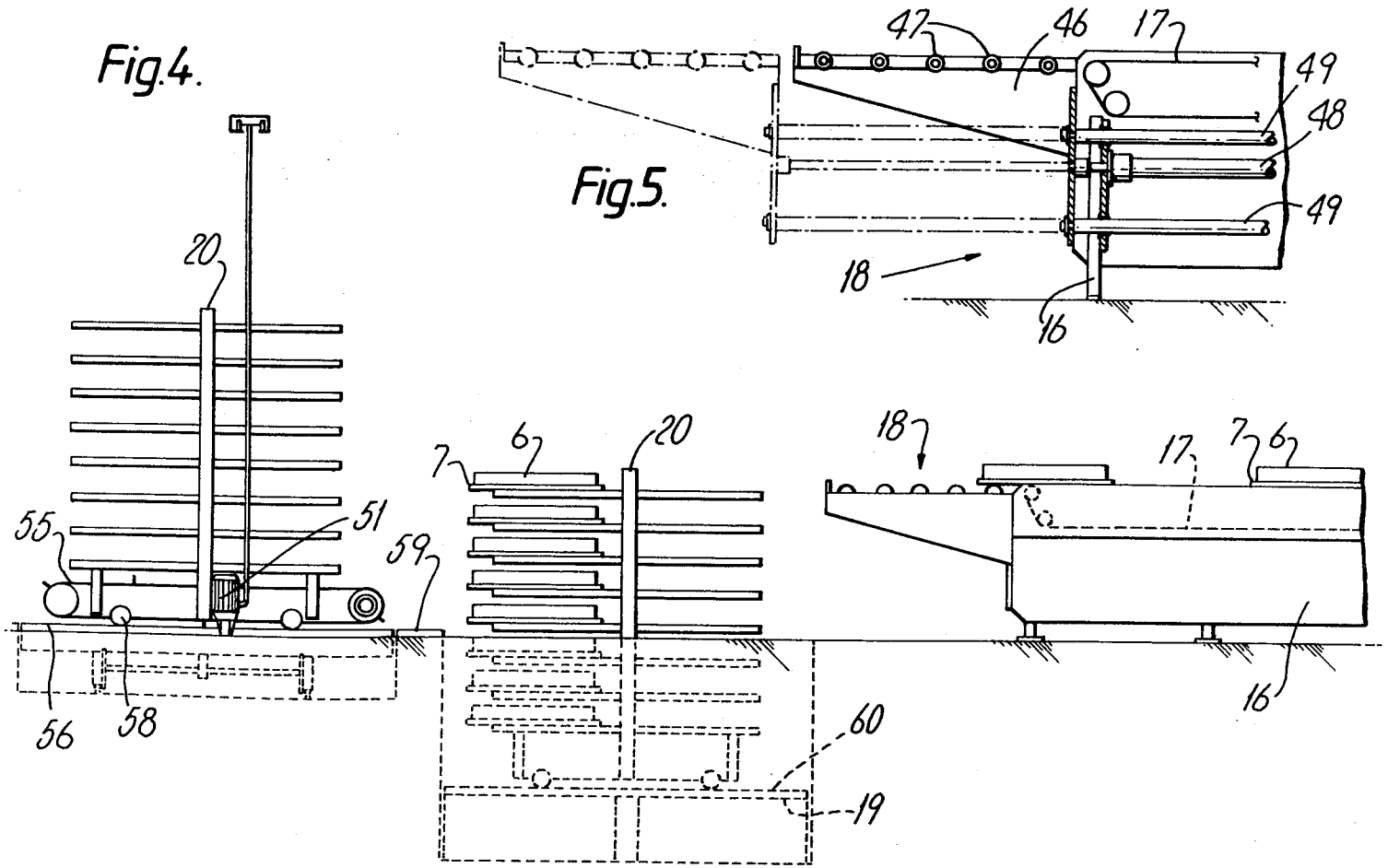
FIG. 4 is a side view of the downstream end of the said vertical parking unit together with the corresponding unloading platform.
FIG. 5 is a longitudinal section through the loading member which is disposed immediately upstream of the platform of the preceding figure.

When in its completely emerged position, each loading member 18 is designed to lie above one half of a rotatable platform 19 disposed immediately beyond the downstream end of the loading member 18 when in its completely withdrawn position (FIG. 4).

Said rotatable platform 19 is composed of a disc lying above a vertically extending cylindrical pit 65 provided in the floor on which the plant in question is installed.

A cylindrical skirt 66 branches from the lower zone of the circumferential edge of said disc, its purpose being to enclose the mouth of the pit 65 when the disc is completely raised, i.e. when it is above the plant floor level.

On the disc of the rotatable platform 19 there are provided two rails 60 disposed symmetrically about a diameter of said disc. Said rails 60 are designed to receive the grooved wheels 58 of suitable trucks 20 for loading shower trays 6.

These trucks 20 (FIG. 11) are of the type comprising two opposing columns of superposed forks. The distance between the arms of the forks is less than the distance between the two rows of rollers 47 of the loading member 18, as in fact is clearly visible in the accompanying FIGS. 6 and 13.

Between the two rails 60 there is disposed an endless chain 63 lying in a vertical plane.

A set of pushers 64 suitably spaced apart equidistantly branch from the links of this chain 63, and are arranged to engage with suitable strikers provided on the bottom of the trucks 20.

Finally, the chain 63 passes about two sprocket wheels of horizontal axis mounted on the disc of the rotatable platform 19, one of these being driven by a chain 62 which passes below said disc and is driven by a suitable geared motor unit 61 fitted to the lower face of said disc.

From the lower central zone of the disc there branches an appendix which is connected to the upper end of a vertical intermediate element 68.

The lower end of this latter is mounted rotatable relative to the top of the rod of a vertically disposed hydraulic cylinder-piston unit 67, the body of which is locked to the central point of the base wall of the pit 65.

Over said appendix which branches from the disc of the rotatable platform 19, there is fixed a tube 69 which is coaxial with said vertical intermediate element 68 and cylinder-piston unit 67.

The tube 69 is guided upperly by a bush 73 which occupies the central zone of a support locked to the top of four columns 41. The lower ends of the columns 41 are locked on a further support which is fixed to the top of four further columns 70 branching from the base of the pit 65.

In addition, the central zone of said second support is occupied by a second bush 72, which acts as a lower guide for the tube 69. To the lower end of this latter there is fixed the hub of a large sprocket wheel 74 over which a chain passes.

This chain passes over a sprocket wheel 76 keyed on the exit shaft of a geared motor unit 77, which is mounted slidable relative to one of the lower columns 70.

The sprocket wheel 76 and sprocket wheel 74 are enclosed in a suitable casing 75, which is rigid with the geared motor unit 77.

As shown in FIGS. 2, 6 and 11, on the opposite side of the rotatable platform 19 to that occupied by the loading member 18 there are provided two rail portions 59 arranged to align themselves with the rails 60 of the rotatable platform 19.

As can be seen in FIG. 11, the other ends of the rails 59 terminate at the corresponding longitudinal edge of a channel 204 provided in the floor on which the plant in question is installed.

As shown in FIG. 2, this channel 204 is disposed transversely to all the casting benches 1.

With reference to FIGS. 11 and 12, on the base of the channel 204 there are provided two rails 22 arranged to receive the flanged wheels 220 of a transfer carriage 21 (FIG. 6).

The transfer carriage 21 comprises two loading platforms, each of which comprises two rails 56 transversely disposed to the aforesaid rails 22.

A chain 55 passing around two sprocket wheels of horizontal axis is provided above the corresponding loading platform of the transfer carriage 21, between each pair of rails 56.

A plurality of pushers 57 spaced equidistantly apart branch from the chain 55, and are arranged to contact suitable strikers provided on the base of the trucks 20.

One of the sprocket wheels about which the chain 55 passes is controlled by a chain 54 which passes below the corresponding loading platform and is driven by a geared motor unit 53 fixed below said loading platform.

As shown in FIGS. 11 and 12, between the two loading platforms of the transfer carriage 21 there is provided a geared motor unit 51, the exit shaft of which extends below the transfer carriage in order to drive, by means of a chain 52, one of the shafts on which the flanged wheels 220 of said transfer carriage 21 are keyed.

The gauge of each pair of rails 56 is identical to the gauge of the rails 59 and of the rails 60 of the rotatable platform 19.

Pairs of rails 36 of a gauge equal to that of the rails 56 terminate at that longitudinal edge of the channel 204 opposite that associated with the rails 59, and extend into the drying chambers of a drier 23.

At the outlet of this latter, as can be seen in FIG. 2, said rails 36 extend towards a second channel entirely similar to that indicated by the reference numeral 204, and on the base of which there are disposed two rails 222 which constitute the track for a transfer carriage 221.

This latter is entirely identical to the transfer carriage 21 heretofore described, and its description will therefore be omitted.

Transversely to those ends of the rails 22 and 222 shown at the top of the accompanying FIG. 2, there is provided a further pair of service rails 24 disposed externally to the drier 23, for transferring the trucks 20, after they have been unloaded, from the rails 222 to the rails 22 by means of a towing device 50.

On the opposite side of the rails 222 to that occupied by the drier there are disposed two rotatable platforms 190 completely identical to the platforms 19 heretofore described.

At the discharge zone of each of the rotatable platforms 190 there is provided an unloading member 118 driven with horizontal reciprocating rectilinear motion, and originating from an unloading station 117.

Said members 118 and 117 are entirely identical to the members 18 and 17 heretofore described.

The two unloading stations 117 lead to a slat conveyor 26 which extends so that it reaches that side of the drier 23 opposite that occupied by the rails 24.

Along the slat conveyor 26 there are disposed an automatic blowing station 27, an engobing station 32, a first glazing station 28, a drier 29, a second glazing station 30 and a second drier 31 as clearly shown in the accompanying FIGS. 1 and 2.

That zone of the conveyor 26 disposed immediately downstream of the drier 31 constitutes the discharge station for the glazed articles which are fed to store for subsequent conveying to a firing furnace. Immediately downstream of this discharge station for the glazed articles there is provided along the conveyor 26 an automatic wash station 33 for the support bases 7 of the shower trays 6 (FIG. 1).

That end part of the conveyor 26 disposed immediately downstream of the automatic station 33 constitutes the discharge station for the support bases 7, which are again conveyed by suitable devices to the casting benches 1 for further use.

The plant heretofore illustrated and described operates as follows. At the beginning of a production cycle, all the moulds 3 of each casting bench 1 are moved up tight against each other towards one end of this latter and are then clamped to form a pack by means of the clamping devices 15.

The flexible hoses from the manifold pipes deriving from the tanks 2 are then connected to the moulds 3.

After this, the manifold pipes are put into communication with the tanks 2 so that the slip penetrates by simple gravity or hydrostatic head into the vertical casting cavities which are defined between the successive pairs of moulds 3 of the casting benches 1.

Said connections are maintained for the normal predetermined casting period, after which the connections are broken and the moulds are left to stand.

When the shower trays 6 which have been formed inside said vertical casting cavities are sufficiently hard, the devices 15 are released, and the previously cast articles are withdrawn from the moulds.

This latter operation is carried out starting from one end of each casting bench 1 by sliding the moulds 3 one at a time along the rails 35 of the casting benches 1.

The movement of each mould 3 enables the corresponding shower tray 6 to be withdrawn from the mould by withdrawing it from its female part so that it remains on the corresponding male part.

At this point, the operator takes a support base 7, rests it against the rear face of the shower tray 6, and then by means of a suitable compressed air nozzle separates the article from the aforesaid male part.

By this means, the shower tray 6 rests on its support base 7, which is deposited on the transfer table 5.

During this stage of the production cycle, the personnel responsible for the mould stripping form the drain hole, by means of a punching tool, in the shower tray 6 which has just been withdrawn from the mould.

After this, the support base 7 together with the overlying shower tray 6 is transferred on to the constantly moving service table 11, which conveys it to the corresponding lifting-lowering device 8.

The operational stages just described proceed in the same manner for all casting benches 1, and the respective roller transfer tables 5 are moved through one step each time a shower tray is withdrawn from its mould.

Said operational stages proceed in the same manner until the mould stripping stage is complete for all casting benches 1.

The support bases 7 which were transferred on to the transfer table 11 are conveyed to the lifting-lowering device 8, which alternately rises and falls in order to move the shower trays 6 towards the accumulation tables 10 which are being loaded.

When the roller table of the lifting-lowering device 8 is in the loading position, its rollers 41 rotate, with reference to FIG. 3, in a clockwise direction, as do the rollers of the service table 11, so as to automatically load, one at a time, the support bases 7 which are present on the service table 11.

When loading has taken place, the rollers 41 stop, and the geared motor 44 is controlled so that it raises the motorised roller table.

When the level occupied by the accumulation table 10 has been reached during the loading stage, the motorised roller table stops, and the rollers 41 are rotated in an anticlockwise direction to discharge the support base 7 on to the accumulation table 10, of which the rollers also rotate in an anticlockwise direction.

It is apparent that the rotation of the rollers of each accumulation table 10 takes place intermittently, i.e. lasts for a time period sufficient to automatically load the support base 7, after which the rollers again stop.

By this means, for each accumulation table 10 the support bases 7 become spaced at an equal distance apart.

After the support base 7 has been discharged, the rollers 41 of the lifting-lowering device 8 stop, and the geared motor 44 causes the roller table to lower.

The subsequent stages take place in the manner heretofore described for each accumulation table 10, all occurring in perfect synchronism because suitable feelers or detectors are provided along the aforesaid paths.

Finally, all the shower trays 6 previously cast on the casting benches 1 are accumulated on the tables 10 of the vertical parking units 4.

The articles are left to stand on these parking units for a suitable time for their hardening.

When the articles are sufficiently hard, the vertical parking units 4 are unloaded by the lifting-lowering devices 88.

At this point it will be certainly apparent that these latter operate in an entirely analogous but reverse manner to the lifting-lowering devices 8, in order to move each recently hardened article to the level of the finishing station 16.

Consequently, the lifting-lowering devices 8 can in fact be defined as the means for loading the vertical parking units 4, while the lifting-lowering devices 88 can be defined as the means for unloading said vertical parking units 4.

Again with reference to FIG. 3, each time the roller table of each individual lifting-lowering device 88 is lowered to the level of the service table 11, the rollers of said lifting-lowering device are made to rotate in an anticlockwise direction, and at the same time the belt 17 is driven.

The search for the shower tray 6 to be unloaded by the roller table of the lifting-lowering device 88 is carried out automatically, whereas the anticlockwise rotation of the rollers of said lifting-lowering device takes place when the personnel responsible for finishing the articles start the belt 17.

At said finishing station, one of the personnel responsible for this operation arranges the edges of the articles in place by means of a suitable striking mass, obviously if this is considered necessary, and the piece is then trimmed and sponged down.

The sponged piece or article is then conveyed to the automatic loading member 18.

On the rotatable platform 19 disposed immediately downstream of the loading member 18 there is a truck 20, the forks of which are disposed parallel to the loading member 18.

Said truck 20, which is empty, has been previously loaded on to the rotatable platform 19 by the transfer carriage 21, which in its turn had withdrawn it from the service rail 24.

Each time an empty truck 20 is loaded on to a platform 19, this latter is lowered completely, obviously under the control of the cylinder-piston unit 67, so that the upper fork of one of the columns of the truck 20 is moved slightly under the level occupied by the loading member 18.

At this point, the loading member 18 is made to emerge under the control of the cylinder-piston unit 48, so that the support base 7 of the article which has just been sponged down is brought over the aforesaid fork.

After this, the loading member withdraws, and the rotatable platform 19 is raised through one step by the cylinder-piston unit 67.

The shower tray loading stages proceed in this manner until one column of forks of the truck 20 is completely full.

After completing the loading of the first column of forks of said truck 20, the rotatable platform 19, driven by the geared motor 77, makes a rotation of 180°, and is lowered completely in order to begin loading the second column of forks of the truck 20, said loading taking place in the aforesaid manner.

Each time a truck 20 has been completely loaded, the transfer carriage 21 is caused to move its then free loading platform into alignment therewith.

When alignment is complete, the full truck which has just been loaded is unloaded from the rotatable platform 19 by means of the chain 63 which is driven by the geared motor 61.

At the same time, the chain 55 of the then free loading platform of the transfer carriage 21 is started, so that the full truck becomes received by this latter.

After this, the said transfer carriage 21 moves through one step in order to align the empty truck 20 present on its second loading platform, with the rotatable platform 19 which has just been unloaded.

After alignment has taken place, the aforesaid chains 55 and 63 are driven in the opposite direction in order to load the empty truck 20 on to the rotatable platform 19.

From this moment onwards, the operations involving the loading of the empty truck 20 just positioned on the rotatable platform 19 continue as described heretofore.

When the empty truck has been discharged, the transfer carriage 21 runs along the rails 22 in order to feed the previously loaded full truck into one of the chambers of the drier 23.

The transfer carriage 21 then again moves to the service rails 24 in order to receive a further empty truck 20, which is then discharged on to one of the rotatable platforms 19 as described heretofore.

The trucks 20 leaving the drier 23 are collected one at a time by the transfer carriage 221, which loads them on to the rotatable platforms 190 after withdrawing the empty trucks from these latter.

As shown in FIG. 2, the empty trucks originating from the rotatable platforms 190 are moved to the corresponding end of the service rails 24 where they are conveyed by the towing device 50 to the track rails of the transfer carriage 21.

The shower trays 6 which have just been dried are unloaded from the trucks 20 on the rotatable platforms 190 by means of the fork unloading member 118.

In contrast to that described heretofore with reference to the loading operations by the loading members 18, the trucks 20 are unloaded in the reverse manner, i.e. starting from the bottom.

The shower trays 6 are then loaded, again automatically, on to the conveyor 26 so as to pass through the stations 27–32.

At the outlet of the drier 31 the shower trays 6 are removed from the corresponding support bases 7 which, still resting on the slat conveyor 26, pass through the wash cabin or station 33 so as to be prepared for further use.

We claim:

1. A plant for manufacturing shaped concave vitreous china articles, of the type comprising at least one casting line or bench on which there slides, and can be locked, a set of plaster moulds which can be clamped into a pack in order to define the casting cavities therebetween, characterised by comprising at least two parallel casting benches (1), each provided with means (13) for drying the respective plaster moulds (3), in combination with a parking structure (4) for the cast articles (6) which is disposed between said two benches, there being provided means (5) for transferring the articles from the casting benches to the central parking structure; means (18), (19) for withdrawing the articles from said parking structure and loading them on to suitable fork trucks (20), means (190), (118) for unloading the articles from said fork trucks (20), and means (21), (221), (50) for moving said fork trucks in a closed cycle within the drier (23).

2. A plant as claimed in claim 1, characterised in that the means for drying the moulds comprise, in each casting bench, a pair of horizontal chambers (13) fed with hot air and extending over the entire length of the respective bench, they being disposed one above and one below said bench and being provided with longitudinal blowing ports directed towards the plaster moulds to be dried.

3. A plant as claimed in claim 1, characterised in that the means for transferring the articles from the respective casting benches to the service table (11) of the parking structure are constituted by a carriage (5) slidable on two horizontal rails (14) provided along each casting bench (1) and along the respective side of the parking structure (4), and supporting a table comprising idle rollers which are coplanar to the rollers of the service table (11) and orthogonal thereto.

4. A plant as claimed in claim 1, characterised in that a transverse trench with a relative transfer carriage (221) equal to those described in claim 1 are disposed downstream of the drier (23).

5. A plant as claimed in claim 1, characterised in that rails (22), (222) disposed in the respective containing trenches of claim 4 are connected together by a transverse rail track (24) disposed to the side of the drier (23) at the same level as the rail portions (56) disposed on the transfer carriages (21), (221).

6. A plant as claimed in claim 1, characterised in that means (190), (118), identical to the means described in claim 5 are provided downstream of the transverse trench disposed downstream of the drier, for discharging the fork trucks (20) and conveying them on to a conveyor (26).

7. A plant as claimed in claim 1, characterised in that said parking structure (4) is constituted by a framework (9) which is as long as the respective casting benches (1), and which supports a plurality of motorised accumulation roller tables (10) one above the other, and a motorised service roller station (11) disposed at the same level as the means (5) which transfer the articles from the casting benches to the structure, and end lifting-lowering means (8), (88) for transferring the articles from one table to another, and for unloading the articles from any one of said tables (10).

8. A plant as claimed in claim 7, characterised in that said lifting-lowering means each comprise a vertically translating slide (40) carrying a horizontal portion of motorised roller table (41), said slide being connected to two endless chains (39) disposed in positions corresponding with the slide guides (38) and conveniently motorised (44).

9. A plant as claimed in claim 1, characterised in that the means for withdrawing the articles from said parking structure (4) and loading them on to the fork trucks (20) consist of a motorised conveyor belt (17) disposed downstream of the unloading lifting-lowering device (88), said belt extending as far as a fork (18) which is driven with reciprocating horizontal motion, and from the inner faces of the arms of which there project two sets of opposing rollers (47) for supporting plates (7) on which the articles (6) are rested, said fork being able to assume two positions, namely a position in which it is adjacent to, and acts as a continuation of the conveyor belt, and a position in which it lies above the support forks of a truck (20).

10. A plant as claimed in claim 9, characterised in that each fork truck (20) comprises two opposing sets of superposed forks which face the opposite ends of the truck.

11. A plant as claimed in claim 1, characterised in that downstream of the unloading fork (18) for the cast articles there is provided a rotatable and vertically translatable platform (19) provided with means (63) for pulling a fork truck on to itself and for pushing a fork truck off itself.

12. A plant as claimed in claim 11, characterised in that the means for pulling and pushing a fork truck are constituted by the upper portion of an endless motorised chain (63) fitted with equidistant strikers (64) which interfere with analogous strikers provided on the truck.

13. A plant as claimed in claim 1, characterised in that downstream of said rotatable platform (19) and upstream of the drier (23) there is disposed a transverse trench (204) in which a transfer carriage (21) slides for receiving a fork truck (20) and for moving it parallel to the drier inlet port.

14. A plant as claimed in claim 13, characterised in that each transfer carriage (21) is provided with means (55), (57) for pulling the fork trucks on to itself and for pushing the fork trucks off itself, said means being equal to those described in claim 12.

* * * * *